US006441568B1

(12) United States Patent
Park et al.

(10) Patent No.: US 6,441,568 B1
(45) Date of Patent: Aug. 27, 2002

(54) ELECTRON GUN FOR CATHODE RAY TUBE

(75) Inventors: In-gyu Park; Young-kon Hong, both of Suwon (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/714,968

(22) Filed: Nov. 20, 2000

(30) Foreign Application Priority Data

Nov. 19, 1999 (KR) ..... 99-51494

(51) Int. Cl.[7] ..... H01J 29/58
(52) U.S. Cl. ..... 315/382; 315/15; 313/414
(58) Field of Search ..... 315/15, 14, 1, 315/382, 382.1, 16, 368.15, 368.11, 364; 313/412–414, 428, 432, 439, 446, 449, 458, 460

(56) References Cited

U.S. PATENT DOCUMENTS

| | | | | | |
|---|---|---|---|---|---|
| 4,772,827 | A | | 9/1988 | Osakabe | 313/414 |
| 4,814,670 | A | | 3/1989 | Suzuki et al. | 315/15 |
| 5,039,906 | A | * | 8/1991 | Park | 313/412 |
| 5,164,640 | A | * | 11/1992 | Son et al. | 313/414 |
| 5,170,101 | A | | 12/1992 | Gorski et al. | 315/368.11 |
| 5,300,855 | A | | 4/1994 | Kweon | 313/414 |
| 5,386,178 | A | * | 1/1995 | Son et al. | 313/414 |
| 5,394,053 | A | | 2/1995 | Yun | 313/414 |
| 5,656,884 | A | | 8/1997 | Lee | 313/412 |
| 5,663,609 | A | * | 9/1997 | Kamohara et al. | 313/412 |
| 5,739,629 | A | * | 4/1998 | Yun et al. | 313/412 |
| 5,965,973 | A | * | 10/1999 | Yang et al. | 313/412 |
| 6,255,788 | B1 | * | 7/2001 | Shirai et al. | 313/414 |

* cited by examiner

*Primary Examiner*—Haissa Philogene
*Assistant Examiner*—Ephrem Alemu
(74) *Attorney, Agent, or Firm*—Robert E. Bushnell, Esq.

(57) ABSTRACT

An in-line three beam electron gun for a color cathode ray tube comprising a cathode for emitting electron beams, a control electrode and a screen electrode, first through fourth focusing electrodes and an accelerating electrode, wherein the third focusing electrode has vertically elongated electron beam apertures to form a quadrupole lens, and the fourth focusing electrode has circular electron beam apertures. A first uni-potential lens is formed between the first and second focusing electrodes, a second uni-potential lens is formed between the second and third focusing electrodes, a quadrupole lens is formed between the third and fourth focusing electrodes and a main leans is formed between the fourth electrode and the accelerating electrode, when a static voltage is applied to the first and second focusing electrodes and a dynamic focusing voltage synchronous to a deflection signal is applied to the third and fourth focusing electrodes.

10 Claims, 3 Drawing Sheets

ELECTRON GUN FOR CATHODE RAY TUBE

CLAIM OF PRIORITY

This application makes reference to, incorporates the same herein, and claims all benefits accruing under 35 U.S.C §119 from an application entitled Electron Gun For Cathode Ray Tube earlier filed in the Korean Industrial Property Office on Nov. 19, 1999, and there duly assigned Ser. No. 99-51494 by that Office.

BACKGROUND OF THE INVENTION

1. Field of the Invention

The present invention relates to a color cathode ray tube (CRT), and more particularly, to an electron gun for a color CRT having improved electrodes for forming an electronic lens.

2. Description of the Related Art

An electron gun used for a large-screen color CRT must satisfy a requirement of generating both low-current electron beams and high-current electron beams in a stable manner. A conventional CRT employs a self-converging deflection yoke having a pin-cushion type deflected magnetic field and a barrel-type deflected magnetic field, and an in-line electron gun. The deflected magnetic field of the deflection yoke over-focuses an electron beam vertically and under-focuses an electron beam horizontally, to cause focus separation. The deformed electron beam spot becomes asymmetrical when it is deflected to the periphery of a screen. Also, an in-line electron gun cannot attain focusing uniformity due to a change in the intensity of an electronic lens caused by a change in the focusing voltage.

In order to prevent a focus deterioration of an electron beam landing on a phosphor layer, an apparatus in which the cross section of an electron beam emitted from an electron gun is made vertically elongated to compensate for distortion due to a non-uniform magnetic field of a deflection yoke, has been proposed.

FIG. 1 shows an example of electrodes of an electron gun for deforming the cross section of an electron beam as disclosed in U.S. Pat. No. 4,772,827 to Kuniharu Osakabe and entitled Cathode Ray Tube and incorporated by reference herein.

As shown in the drawing, circular electron beam apertures 11 are formed on a first electrode 10, and four vertical blades 12 are formed at either side of the electron beam apertures 11. Circular electron beam aperture 21 are formed on a second electrode 20 which is disposed opposite to the first electrode 10, and two single horizontal blades 22 are respectively installed above and below the circular electron beam apertures 21. A predetermined focusing voltage VF is applied to the first electrode 10, and a dynamic focusing voltage VFd synchronous to a deflection signal produced when an electron beam is deflected toward the periphery of the screen is applied to the second electrode 20.

In the first and second electrodes 10 and 20 of an electron gun for forming the above-described conventional quadrupole (four pole) lens, the quadrupole lens formed by application of the focusing voltage and the dynamic focusing voltage synchronous to the deflection signal is affected by the blades 12 and 22 so that distortion of the quadrupole lens becomes severe, which causes a vertical haze when astigmatism is relatively elongated horizontally, resulting in deterioration in focusing characteristics over the entire screen. In particular, when a dynamic focusing voltage of a high waveform is applied, a haze due to vertical over-focusing of an electron beam is generated, in spite of improvement in horizontal focusing characteristics.

In order to form a quadrupole lens, a relatively high waveform voltage must be applied to the electrodes 10 and 20, which causes an increase in the cost required for circuit construction. Also, since the blades 12 and 22 are installed to be opposite to each other, it is quite difficult to assemble an electron gun employing such electrodes.

Another example of electrodes of an electron gun for a conventional color CRT is illustrated in U.S. Pat. No. 4,814,670 to Hiroshi Suzuki et al. and entitled Cathode Ray Tube Apparatus Having Focusing Grids With Horizontally And Vertically Oblong Through Holes, in which three vertically elongated electron beam apertures are formed on the exit side of a first focus electrode for forming a quadrupole lens, and a horizontally elongated electron beam aperture through which all of three electron beams pass is formed on the entrance side of a second focus electrode installed to face the first focus electrode, for forming the quadrupole lens. A static focusing voltage is applied to the first focus electrode and a dynamic focusing voltage synchronous to a deflection signal is applied to the second focus electrode.

In the above-described electron gun, since a single horizontally elongated electron beam aperture is formed on the second focus electrode, the intensities, that is, magnifications, between the center of an electronic lens formed by the first and second focus electrodes and either side thereof are different. Thus, the sizes of electron beam spots landing on left and right sides of a screen are different, causing a moire.

Additional references describing electron guns using quadrupole lenses for preventing astigmatism and incorporated by reference herein are: U.S. Pat. No. 5,656,884 to Soo Keun Lee entitled Electron Gun Of A Color Picture Tube For Preventing Astigmation; U.S. Pat. No. 5,394,053 to Neung-yong Yun entitled Electron Gun For A Color Cathode Ray Tube; U.S. Pat. No. 5,300,855 to Yong-geol Kweon entitled Electron Gun For A Color Cathode Ray Tube; and U.S. Pat. No. 5,170,101 to Richard M. Gorski et al. entitled Constant Horizontal Dimension Symmetrical Beam In-Line Electron Gun.

SUMMARY OF THE INVENTION

To solve the above problems, it is an object of the present invention to provide an electron gun for a color CRT, which can reduce a dynamic focusing voltage and can improve the resolution of an image by reducing the astigmatism of an electronic lens.

To accomplish the above object, there is provided an electron gun for a color cathode ray tube comprising a cathode for emitting electron beams, a control electrode and a screen electrode, sequentially installed from the cathode, constituting a triode, a first focusing electrode having vertically elongated electron beam apertures, disposed next to the screen electrode to form a quadrupole lens, a second focusing electrode having circular electron beam apertures, and a final accelerating electrode disposed next to the second focusing electrode to form a main lens, wherein a static voltage is applied to the first focusing electrode and a dynamic focusing voltage synchronous to a deflection signal is applied to the second focusing electrode.

In the present invention, the voltage applied to the first focusing electrode is 200 to 1500 V higher than that applied to the second focusing electrode.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
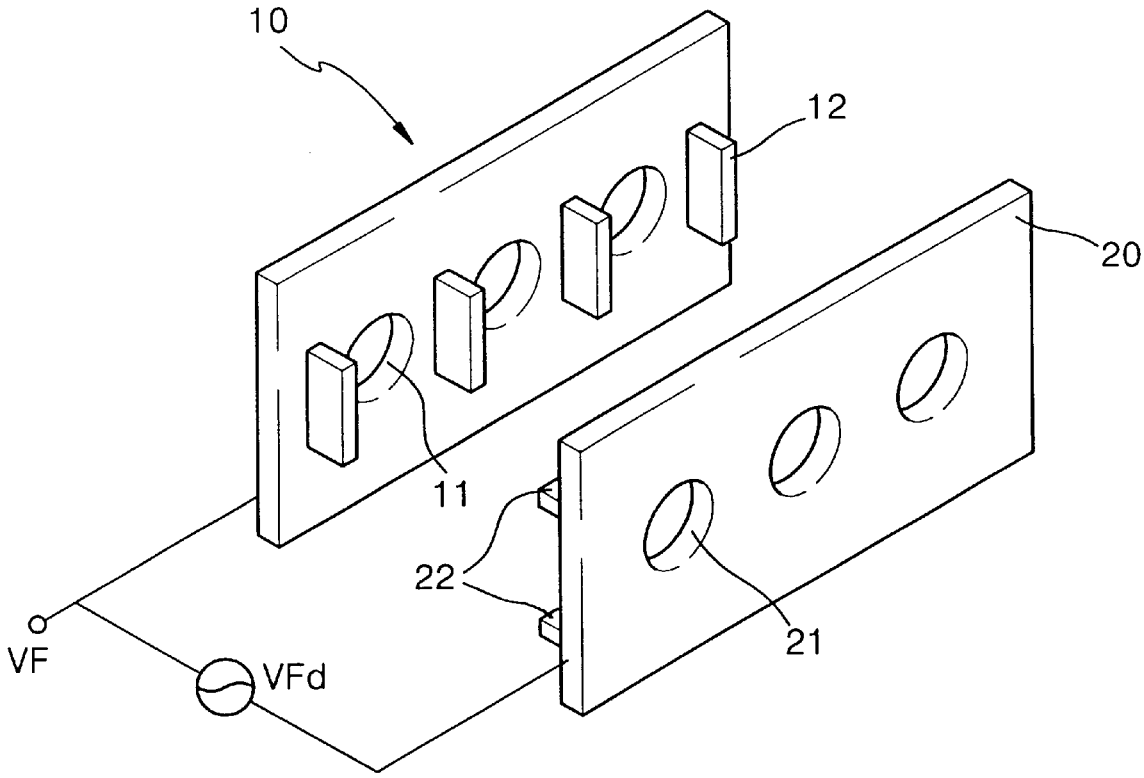
FIG. 1 (PRIOR ART)
FIG. 1 is a perspective view illustrating a conventional electron gun for a color CRT.
Figure 2:
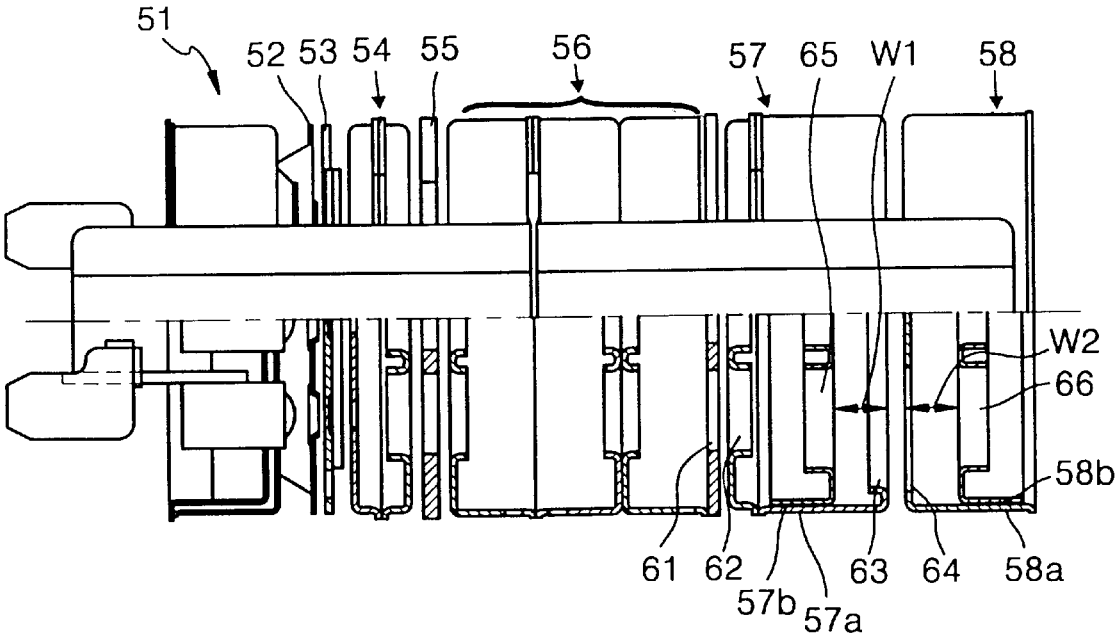
FIG. 2 is a partially exploded cross-sectional view illustrating an electron gun according to the present invention.

An electron gun mounted in a neck portion of a funnel of a CRT, emits an electron beam for exciting a phosphor layer, and an embodiment thereof is illustrated in FIG. 2.

As shown in the drawing, an electron gun includes a cathode 51, a control electrode 52 and a screen electrode 53, constituting a triode, first through fourth focusing electrodes 54, 55, 56 and 57, sequentially installed from the screen electrode 53, for forming an auxiliary lens and at least one quadrupole lens, and a final accelerating electrode 58 installed next to the fourth focusing electrode 57, for forming a main lens having a focusing lens and a convergent lens.

Figure 3:
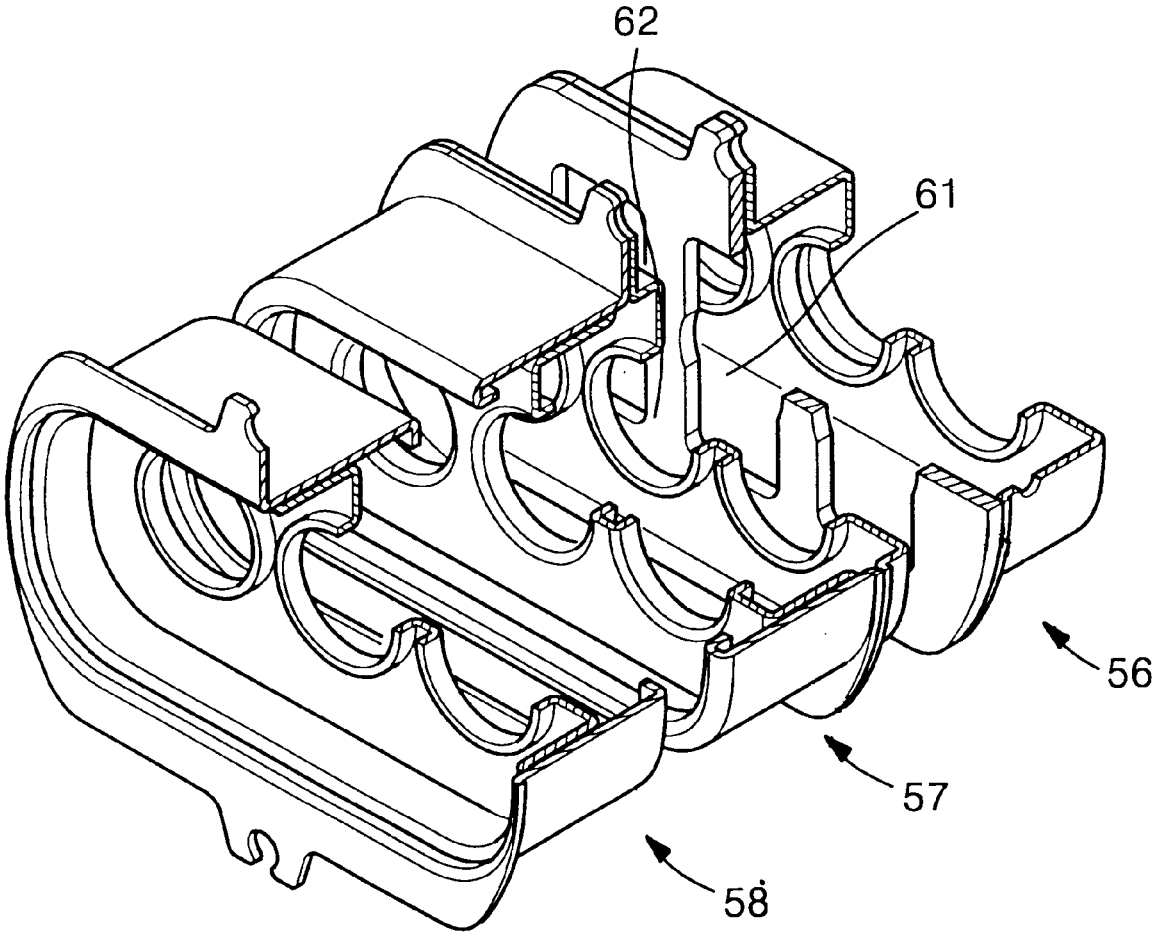
FIG. 3 is an exploded perspective view illustrating electrodes for forming a quadrupole lens.

Three electron beam apertures arranged in an in-line configuration or an electron beam aperture through which three electron beams pass are formed on the respective electrodes. According to a feature of the present invention, as shown in FIG. 3, three vertically elongated electron beam apertures 61 are formed on the exit side of the third focusing electrode 56, and three circular electron beam apertures 62 are formed on the entrance side of the fourth focusing electrode 57. Also, outer electrode members 57*a* and 58*a* having large electron beam apertures 63 and 64 through which all of three electron beams pass, are formed on the exit side of the fourth focusing electrode 57 and on the entrance side of the final accelerating electrode 58, respectively, and inner electrode members 57*b* and 58*b* having separate small electron beam apertures 65 and 66 are formed inside the outer electrode members 57*a* and 58*a*, respectively. Here, a distance W1 from one end of the outer electrode member 57*a* of the fourth focusing electrode 57 to the inner electrode member 57*b* is greater than a distance W2 from one end of the outer electrode member 58*a* of the final accelerating electrode 58 to the inner electrode member 58*b*.

The number of focusing electrodes constituting the auxiliary lens and the number of quadrupole lenses formed by the focusing electrodes are not limited to those described in the aforementioned embodiment. For example, a plurality of quadrupole lenses may be provided.

Predetermined voltages are applied to the respective electrodes of the electron gun having the aforementioned configuration. In other words, predetermined static voltages may be applied to the control electrode 52, the screen electrode 53 and the first and second focusing electrodes 54 and 55, and dynamic focusing voltages synchronous to a deflection signal may be applied to at least one of the third and fourth focusing electrodes 56 and 57 constituting the quadrupole lens. Here, the dynamic focusing voltage applied to the third focusing electrode 56 is higher than that applied to the fourth focusing electrode 57. A voltage difference between the third and fourth focusing electrodes 56 and 57 is preferably 200 to 1500 V.

Application of voltages to the respective electrodes of the electron gun is not limited to the aforementioned embodiment, but appropriate voltages may be applied for focusing electron beams by forming at least two quadrupole lenses.

The operation of the electron gun for a color CRT having the aforementioned configuration will now be described.

If a voltage is applied to electrodes constituting the electron gun, a pre-focusing lens is formed between the screen electrode 53 and the first focusing electrode 54, uni-potential electronic lenses are formed between each of the first, second and third focusing electrodes 54, 55 and 56, a quadrupole lens is selectively formed between the third and fourth focusing electrodes 56 and 57 according to deflection of an electron beam, and a main lens is formed between the fourth focusing electrode 57 and the final accelerating electrode 58.

As described above, the intensities of electronic lenses between each of the respective electrodes and focusing depend on the scanning position of an electron beam, which will now be described.

First, when an electron beam emitted from the electron gun is scanned on the central portion of a phosphor layer, since the voltage applied to the third focusing electrode 56 is higher (approximately 200 to 1500 V higher) than that applied to the fourth focusing electrode 57, a relatively weak quadrupole lens is formed therebetween. Thus, the electron beam emitted from the cathode 51 is pre-focused and accelerated by the uni-potential auxiliary electronic lens and the quadrupole lens, and is finally focused and accelerated by the main lens, to then land on the central portion of the phosphor layer.

Here, since the vertically elongated electron beam apertures 61 and circular electron beam apertures 62 are formed on facing surfaces of the third and fourth focusing electrodes 56 and 57, the electron beams having passed through these apertures are applied to a relatively strong divergent force vertically. However, since a relatively high voltage is applied to the third focusing electrode 56, a difference in dynamic focusing voltage between the respective electrodes can be reduced, thereby reducing a vertical haze. The reduction in the vertical haze reduces astigmatism of the electron beam passing through the quadrupole lens.

When an electron beam emitted from the electron gun is scanned on the peripheral portion of a phosphor layer, since a dynamic focusing voltage synchronous to a deflection signal is applied to at least one of the third and fourth focusing electrodes 56 and 57, a quadrupole lens having a relatively large magnification is formed between therebetween. Also, since a dynamic focusing voltage is applied to the fourth focusing electrode 57, a voltage difference between the fourth focusing electrode 57 and the final accelerating electrode 58 is reduced, so that the magnification of the main lens becomes relatively smaller.

Thus, the electron beam emitted from the cathode 51 is pre-focused and accelerated by the uni-potential auxiliary electronic lens and then is applied to vertically strong divergent force by the quadrupole lens formed between the third and fourth focusing electrodes 56 and 57 to then be vertically elongated. The vertically elongated electron beam is deflected by the deflected magnetic field of the deflection yoke to then land on the peripheral portion of the phosphor layer. Here, since the magnification of the main lens becomes weaker, the focal length is increased, so that the astigmatism is improved. Also, since a distance W1 between one end of the outer electrode member of the fourth focusing electrode 57 and the inner electrode member is greater than a distance W2 between one end of the outer electrode member of the final accelerating electrode 58 and the inner electrode member, the divergent force of the main lens is relatively smaller, thereby improving focusing and convergence characteristics.

As described above, in the electron gun for a color CRT according to the present invention, astigmatism is made vertically elongated, thereby preventing deterioration of focusing characteristics due to vertical haze produced when a voltage synchronous to a deflection signal is applied to focusing electrodes.

The experimental results carried out by the present inventors showed that when the third and fourth focusing electrodes 56 and 57 for forming a quadrupole lens are designed to have a voltage difference of approximately 400 V, the present invention electron gun exhibited a noticeable reduction in the waveform of a voltage, that is, 430 V, compared to 550 V in the conventional electron gun. Also, when an electron beam is scanned into the central portion of the screen, vertical focusing characteristics can be improved.

While the present invention has been described in conjunction with the preferred embodiment disclosed, it will be apparent to those skilled in the art that various modifications and variations can be made within the spirit or scope of the invention. Therefore, the true scope of the invention should be defined by the appended claims.

What is claimed is:

1. A three beam in-line electron gun for a color cathode ray tube comprising:

a triode;

first through fourth focusing electrodes; and an accelerating electrode, wherein a pre-focusing lens is formed between said triode and said first focusing electrode, a first uni-potential lens is formed between said first and second focusing electrodes, a second uni-potential lens is formed between said second and third focusing electrodes, a quadrupole lens is formed between said third and fourth focusing electrodes and a main lens is formed between said fourth focusing electrode and said accelerating electrode, when a static voltage is applied to the first and second focusing electrodes and a dynamic focusing voltage synchronous to a deflection signal is applied to the third and fourth focusing electrodes.

2. The electron gun as set forth in claim 1, wherein the dynamic focusing voltage applied to said third focusing electrode is greater than the dynamic voltage applied to said fourth focusing electrode.

3. The electron gun as set forth in claim 1, wherein a difference between the dynamic focusing voltages applied to the third and fourth focusing electrodes is between 200 to 1500 volts.

4. The electron gun as set forth in claim 1, wherein a difference between the dynamic focusing voltages applied to the third and fourth focusing electrodes is approximately 400 volts.

5. The electron gun as set forth in claim 1, wherein said triode is comprised of a cathode for emitting electron beams, a control electrode and a screen electrode, said static voltage being applied to said control electrode and said screen electrode.

6. The electron gun according to claim 1, wherein each of said focusing electrodes include at least three electron beam passing apertures, said third focusing electrode receiving said electron beams through three circular apertures and passing said electron beams to said fourth focusing electrode through three vertically elongated apertures.

7. The electron gun according to claim 6, wherein said fourth focusing electrode comprises an inner electrode and an outer electrode, said inner electrode having three circular apertures for passing said electron beams to said outer electrode, said outer electrode having a single large electron beam aperture for passing said electron beams to said accelerating electrode.

8. The electron gun according to claim 7, wherein said accelerating electrode comprises an inner electrode and an outer electrode, said outer electrode having a single large electron beam aperture for passing said electron beams received from said fourth focusing electrode to said inner electrode, said inner electrode having three circular apertures for passing said electron beams to a screen of said cathode ray tube.

9. The electron gun according to claim 8, wherein a distance between an end of said inner electrode of said fourth focusing electrode and an end of said outer electrode of said fourth focusing electrode is greater than a distance between an end of said inner electrode of said accelerating electrode and an end of said outer electrode of said accelerating electrode.

10. The electron gun according to claim 6, wherein each of said three vertically elongated apertures of said third focusing electrode are rectangularly elongated vertically and have a centrally located circular cutout portion.

* * * * *